US009951594B2

(12) United States Patent
Trost

(10) Patent No.: US 9,951,594 B2
(45) Date of Patent: Apr. 24, 2018

(54) METHOD OF UTILIZING CARBON MONOXIDE TO INCREASE OIL RECOVERY

(71) Applicant: Paul Trost, Golden, CO (US)

(72) Inventor: Paul Trost, Golden, CO (US)

( * ) Notice: Subject to any disclaimer, the term of this patent is extended or adjusted under 35 U.S.C. 154(b) by 0 days.

(21) Appl. No.: 14/621,531

(22) Filed: Feb. 13, 2015

(65) Prior Publication Data

US 2015/0240610 A1 Aug. 27, 2015

Related U.S. Application Data

(63) Continuation-in-part of application No. 13/935,925, filed on Jul. 5, 2013, now abandoned, and a continuation-in-part of application No. 13/438,820, filed on Apr. 3, 2012, now abandoned.

(60) Provisional application No. 61/940,018, filed on Feb. 14, 2014.

(51) Int. Cl.

| | |
|---|---|
| ***E21B 43/26*** | (2006.01) |
| ***E21B 43/16*** | (2006.01) |
| ***E21B 41/02*** | (2006.01) |

(52) U.S. Cl.
CPC ..... *E21B 43/168* (2013.01); *E21B 41/02* (2013.01); *E21B 43/26* (2013.01)

(58) Field of Classification Search
None
See application file for complete search history.

(56) References Cited

U.S. PATENT DOCUMENTS

| | | | | |
|---|---|---|---|---|
| 2,957,818 | A * | 10/1960 | Fischer | C10G 1/045 208/390 |
| 3,007,520 | A * | 11/1961 | Frey | E21B 43/243 166/245 |
| 3,342,259 | A | 9/1967 | Powell | |
| 3,457,996 | A * | 7/1969 | Parker | E21B 43/24 166/288 |
| 4,183,405 | A | 1/1980 | Magnie | |
| 5,950,728 | A | 9/1999 | Bingham | |
| 7,100,692 | B2 | 9/2006 | Parsley et al. | |
| 7,341,102 | B2 | 3/2008 | Kresnyak et al. | |
| 7,506,685 | B2 * | 3/2009 | Zubrin | E21B 43/164 166/268 |
| 7,644,756 | B2 | 7/2010 | Zhang et al. | |
| 7,866,389 | B2 | 1/2011 | De Francesco et al. | |
| 8,627,886 | B2 | 1/2014 | O'Connor et al. | |
| 8,991,491 | B2 | 3/2015 | Kalinowski et al. | |

(Continued)

FOREIGN PATENT DOCUMENTS

| | | |
|---|---|---|
| WO | 2008043833 | 4/2008 |
| WO | 2013013295 | 1/2013 |

OTHER PUBLICATIONS

Daniels et al., "Carbon Monoxide Oxidation by Methanogenic Bacteria," Oct. 1977, Journal of Bacteriology, vol. 132, No. 1, pp. 118-126.*

(Continued)

*Primary Examiner* — Angela M DiTrani
(74) *Attorney, Agent, or Firm* — Holzer Patel Drennan

(57) ABSTRACT

A method of utilizing carbon monoxide to increase oil recovery includes methods of injecting an effective amount of carbon monoxide into an oil reservoir. The carbon monoxide increases oil flow from the oil reservoir through a variety of chemical mechanisms.

23 Claims, 12 Drawing Sheets

THERMODYNAMIC DATA SUPPORTING THE REDUCING EFFECTS OF CO ON OXIDIZED IRON COMPOUNDS

$$CO + 2Fe(OH)_3 \rightarrow CO_2 + 2FeO + 3H_2O \qquad \Delta F = -9 \text{ kcal}$$

$$CO + 2Fe(OH)_3 \rightarrow CO_2 + Fe_2O_3 + 2H_2O + 2H+ \qquad \Delta F = -15 \text{ kcal}$$

*NOTE: A negative ΔF (Free Energy) value demonstrates the reaction will proceed.*

(56) References Cited

U.S. PATENT DOCUMENTS

| | | | | |
|---|---|---|---|---|
| 2004/0033557 | A1* | 2/2004 | Scott | C09K 8/582 435/42 |
| 2005/0239661 | A1 | 10/2005 | Pfefferle | |
| 2008/0217008 | A1* | 9/2008 | Langdon | E21B 36/02 166/270 |
| 2011/0046244 | A1 | 2/2011 | Zubrin | |
| 2011/0186296 | A1* | 8/2011 | Cassidy | C10G 1/02 166/302 |

OTHER PUBLICATIONS

"reducing atmosphere" retrieved Feb. 22, 2017 from https://en.wikipedia.org/wiki/Reducing_atmosphere.*

Montano, Characterization of Iron Bearing Minerals in Coal, 1981, Department of Physics, West Virgina University.*

S. Sayegh, S. Huang, Y.P. Zhang, R. Lavoie, Effect of H2S and Pressure Depletion on the CO2 MMP of Zama Oils, Journal of Canadian Petroleum Technology.

James P. Meyer Phd, Summary of Carbon Dioxide Enhanced Oil Recovery (CO2EOR) Injection Well Technology, American Petroleum Institute.

Liu, et al., "Flue gas enhanced oil recovery (EOR) as a highly efficient development technology for off shore heavy oil in China"; Journal of Petroleum and Gas Engineering, v. 4(5), pp. 127-142, May 2013, 16 pages.

Johnson, et al., "A Flue Gas Huff & Puff Process for Oil Recovery From Shallow Formations"; Society of Petroleum Engineers. SPE Paper 20269-MS, Jan. 1990, Abstract only.

Watts, "Alternative Gas Injection Process" EORI Conference, The Linde Group, Sep. 2012, 32 pages.

Zhu, et al., "An EOR Application at Liaohe Oil Field in China"; First National Conference on Carbon Sequestration, Washington D.C., May 2001, 10 pages.

* cited by examiner

FIGURE 1

THERMODYNAMIC DATA SUPPORTING THE REDUCING EFFECTS OF CO ON OXIDIZED IRON COMPOUNDS $CO + 2Fe(OH)_3 \rightarrow CO_2 + 2FeO + 3H_2O$ $\Delta F$ = -9 kcal $CO + 2Fe(OH)_3 \rightarrow CO_2 + Fe_2O_3 + 2H_2O + 2H+$ $\Delta F$ = -15 kcal

*NOTE: A negative ΔF (Free Energy) value demonstrates the reaction will proceed.*

FIGURE 2
LACK OF OIL RECOVERY AT CO
CONCENTRATIONS OF < 3% CO

Composition of Gas Injected: *$CO_2$ 97.1% CO 2.9%*
Source of Oil: *LAK field, Newcastle WY*
Type of Oil: *Paraffinic, 19 gravity, 140 centipoise viscosity, reservoir temperature 50° F,*
Pore Volume of 97.1% $CO_2$ and 2.9% CO injected: *1.7 pore volumes*
Pore Volume of Oil Recovered: *3.9%*

FIGURE 3

RECOVERY OF VISCOUS NAPHTHENIC/ASPHALTENE OIL BY CO AND $CO_2$ AT LOW RESERVOIR PRESSURE

TAYLOR BIRD LEASE, LEAVANWORTH, KS

Initial Boiling Pt. = 30% > 590° F; Oil Viscosity @ 90° F = 143 cp; API Gravity = 24°; Density = 0.899 g/ml

| Field and Experimental Conditions | Pressure, psi | % OIL RECOVERED |
|---|---|---|
| Reservoir field pressure (as received) | 30 | Not Applicable |
| Reservoir pressure in slim tube inlet | 500 | Not Applicable |
| Reservoir pressure at outlet (point 1) | 270 | 27.0% |
| Reservoir pressure at outlet (point 2) | 0 | 81.5% |

FIGURE 4

INCREASED PERMEABILITY OF A RESERVOIR THAT HAS IRON-BEARING MINERALS AND HAS SUFFERED FORMATION DAMAGE

Test Apparatus: Sand and 5% bentonite packed column, 2" diameter and 12" long

Baseline Formation Damaged Permeability: 4.8 md (millidarcys)

Post CO Treatment to Improve Permeability: 9.1 md (millidarcys)

EFFECT OF CARBON MONOXIDE ON LINEAR CORE FLOOD TO INCREASE RESERVOIR MATRIX PERMEABILITY

EORGAS™

RESERVOIR PERMEABILITY INCREASE (2 PHASE FLUID FLOW)

| CONDITIONS | mD |
|---|---|
| Initial Gas Permeability | 0.0004 |
| After CO Treatment (275%) | 0.0011 |
| Initial Water Permeability | 0.0091 |
| After CO Treatment (147%) | 0.0134 |

FIGURE 5
INTERFACIAL TENSION (IFT) LOWERING BY CO

CO-EORGAS
IFT EFFECT
(GRIEVE OIL)

| PRESSURE | OIL | WATER | IFT LOWERING |
|---|---|---|---|
| | CO, ppm ($C_6$) | CO, ppm | |
| 14 psi | <1600 | 28 | 18.8 w/o CO<br>15.9 w/ CO |
| 2000 psi | 52,000 ($C_6$) | ~880 | 1.9(est) |

NOTE: The IFT of the oil sample without the presence of CO was 18.8 dynes/cm2 whereas with the CO the IFT decreased to 15.9 dynes/cm2, thus demonstrating a lowering of the IFT.
NOTE: Since reservoir pressures commonly exceed atmospheric pressures, the lowering of the IFT will be greater due to the higher solubility of CO in the oil relative to the water.

FIGURE 6

RISING BUBBLE APPRATUS DEMONSTRATING A CHEMICAL INTERACTION BETWEEN CO AND $CO_2$ TO ACHIEVE HIGHER RATES OF GAS SOLUBILIZATION INTO VARIOUS CRUDE OILS

Rising Bubble Apparatus Dissolution Tests, %

| PROJECT / OIL | OIL TYPE | CO | CO2 | EORGAS | PRESS psi / TEMP ° F |
|---|---|---|---|---|---|
| LAK 18 ° Gravity | Paraffinic | 25 | 35 | 50 | 450/85 |
| Taylor Bird 19 ° Gravity | Aromatic + Minor Parafins | 37 | 54 | 94 | 500/105 |
| Grieve Oil 32 ° Gravity | Paraffinic + Trace Aromatics | ND | ND | 74 | 500/135 |
| Morton Field 42 ° Gravity | Paraffinic | ND | ND | 77 | 500/95 |

EFFECTS OF NITROGEN ON OIL RECOVERY USING A GAS MIXTURE OF CO AND $CO_2$ SHOWING ONLY MINIMAL LOSS OF OIL RECOVERY AT N2 CONCENTRATION OF 66% AND CO/$CO_2$ CONCENTRATION OF 34%

EFFECTIVENESS OF EORGAS (66% $CO_2$ AND 34% CO) TO RECOVER ADDITIONAL OIL AFTER WATER FLOODING HAS REACHED ITS ECONOMIC LIMITS, AND FASTER RATE OF OIL RECOVERY AS COMPARED TO PURE $CO_2$ UNDER SAME EXPERIMENTAL CONDITIONS

FIGURE 9
(Continued from Figure 8)
FASTER RATE OF OIL RECOVERY WITH CO AS COMPARED TO $CO_2$
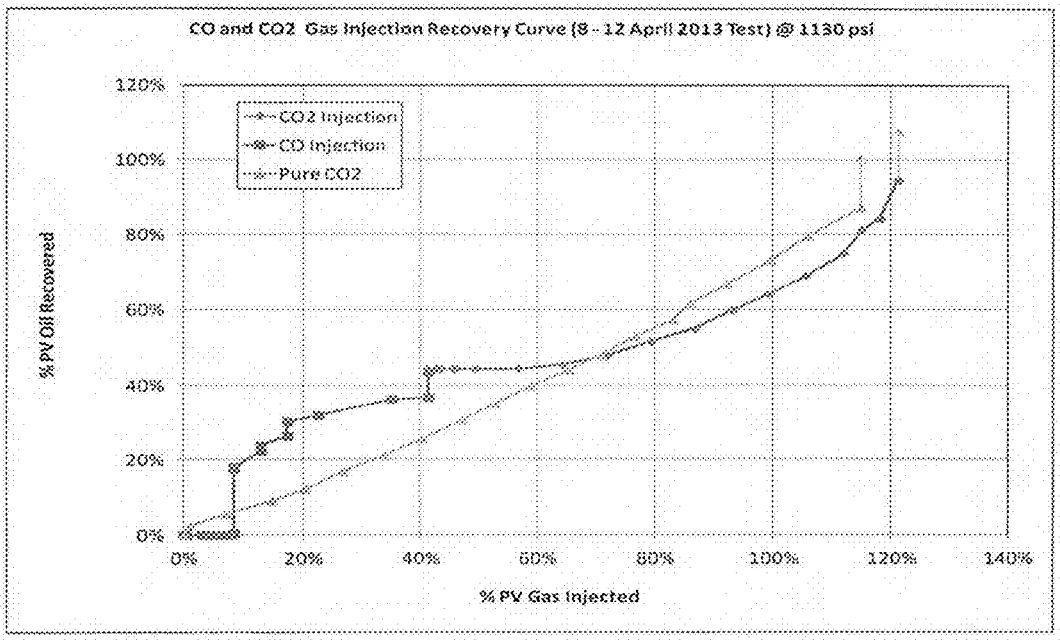

FASTER RATE OF OIL RECOVERY WITH EORGAS (COMBINATION OF 30% CO + 60% $CO_2$ + 10% $N_2$))

FASTER RATE OF OIL RECOVERY FOR EORGAS (60% $CO_2$, 30% CO, AND 10% $N_2$) AS COMPARED TO PURE CO2 AT 1120 PSI

DEMONSTRATION OF CAPABILITY OF PURE CO TO RECOVERY OIL AND AT A FASTER RATE THAN PURE $CO_2$ AND DEMONSTRATION OF PURE $CO_2$ FOLLOWING THE CO OIL RECOVERY TO RECOVER ADDITIONAL OIL AS COMPARED TO PURE $CO_2$.

METHOD OF UTILIZING CARBON MONOXIDE TO INCREASE OIL RECOVERY

This application claims the benefits under U.S. Code, Section 119(e) and U.S. Code, Section 120 of U.S. Provisional Application 61/940,018 dated Feb. 14, 2014; U.S. patent application Ser. No. 13/935,925 filed Jul. 5, 2013; and U.S. patent application Ser. No. 13/438,820 filed on Apr. 3, 2012.

BACKGROUND OF THE DISCLOSURE

Field of the Disclosure

The disclosure relates to oil recovery methods and more particularly pertains to a new oil recovery method for increasing flow rate and total recovery of oil and/or gas from a reservoir.

SUMMARY OF THE DISCLOSURE

An embodiment of the disclosure meets the needs presented above by generally comprising a method of injecting an effective amount of carbon monoxide into an oil reservoir. The carbon monoxide increases oil flow from the oil reservoir through a variety of chemical mechanisms, which in turn also increases a total amount of oil recovered.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 1 is a table showing the reducing effects of carbon monoxide on oxidized iron compounds of a method of utilizing carbon monoxide to increase oil recovery according to an embodiment of the disclosure.

FIG. 2 is a table showing lack of oil recovery enhancement for volumes of carbon monoxide at less than 3.0%.

FIG. 3 is a table indicating recovery of viscous oil with carbon monoxide and carbon dioxide.

FIG. 4 is a table demonstrating increased permeability of an oil reservoir containing iron bearing minerals by injection of carbon monoxide.

FIG. 5 is a table describing the effect on interfacial tension by addition of carbon monoxide.

FIG. 6 is a table teaching the solubility of gases into various crude oils and the increase with a combination of carbon monoxide and carbon dioxide.

FIG. 9 is a graph demonstrating the capability of pure carbon monoxide to recover oil at a faster rate than pure carbon dioxide.

DESCRIPTION OF THE PREFERRED EMBODIMENT

Figure 7:
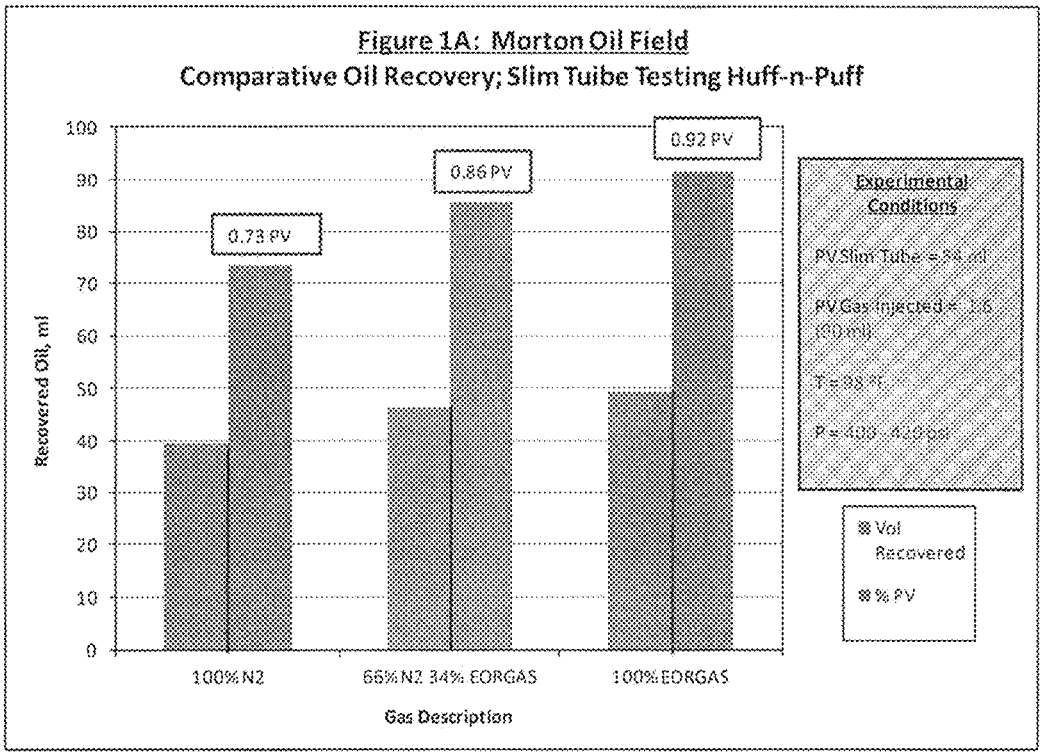
FIG. 7 is a graph indicating the effects of nitrogen on oil recovery using a gas mixture including carbon monoxide and carbon dioxide.

With reference now to the drawings, and in particular to FIGS. 1 through 12 thereof, a new oil recovery method embodying the principles and concepts of an embodiment of the disclosure will be described.

As best illustrated in FIGS. 1 through 12, the method of utilizing carbon monoxide to increase oil recovery generally comprises adding carbon monoxide to an oil well for the purpose of enhancing oil recovery as well as protecting the oil well from decomposing forces. Carbon monoxide (CO) has particular chemical properties due its electron cloud configuration that results in limited solubility in paraffinic hydrocarbons and high solubility in benzene, toluene, ethylbenzene, and asphaltenes. Further, CO is a very good reducing agent and is oxidized to carbon dioxide ($CO_2$). The molecular diameter of CO is 112.8 pm as compared to $CO_2$ being 232 pm. The smaller molecular diameter for CO has been found to result in a faster rate of movement into and through many natural materials such as water, hydrocarbons and oil/gas reservoirs.

CO has a critical temperature point of 132° K (−222° F.), and the critical pressure for CO is 34 atm (476 psi). Thus, contrary to $CO_2$, achieving the critical point for CO is very difficult. However this low critical point may be beneficial for the recovery of oil under immiscible conditions. CO's solubility in paraffinic, aromatic and asphaltene hydrocarbons may also be beneficial in the recovery of oil from oil reservoirs under primary, secondary, and/or tertiary oil recovery operations. As an example of CO solubility in paraffinic hydrocarbons, the mole fraction solubility in hexane varies from 0.02 to 0.3 depending on pressure. This high solubility at pressures, common to oilfield applications, may be beneficial for all types of oil recovery operations.

Further, the relatively strong reducing nature of CO could be beneficial in oil recovery operations from reservoirs that have significant iron-bearing minerals (clays), chlorite, glauconite, iron-bearing limestones and dolomites, and iron compounds adsorped or absorped onto the mineral surfaces. Typically the reducing nature of the CO on iron hydroxides and oxides results in either elemental iron or a reduction in valence state from +3 to +2 valance state (see FIG. 1). Carbon monoxide may therefore be helpful with known problems such as the acidization of limestone reservoirs when iron is present. The beneficial reactions of carbon monoxide resulting in a reduction of valance state on iron-containing minerals and rocks can result in a stabilization of clays, an increase in the reservoir matrix permeability, a minimization of iron migration and its subsequent plugging of the reservoir rock during acidification of iron-bearing limestone and dolomites. Due to the small diameter of the CO molecule, coupled with its unique electron cloud configuration, it has been found that CO, when injected into a reservoir, will move through the reservoir rock, the oil, and the water at a fast rate. Due to its solubility in oils even at low pressures, typically less than the Minimum Miscibility Point of $CO_2$ in the reservoir oil, the rate of oil production to the producing well is thus increased. Addition of CO can occur either in a pure CO form, as a mixture of gases primarily containing $CO_2$ and CO, or as a mixture of gases containing $CO_2$, CO, $N_2$, CH4 and other gases, or as a mixture of gases CO, $H_2$, minor $CO_2$, minor $CH_4$, and water vapor.

Production of CO may occur as either pure CO or as a component of a mixture of gases, referred to as EORGAS. CO, or CO in a mixture of gases, may be produced by any number of conventional industrial processes including, for instance, pyrolysis of organic compounds, the burning of natural gas or the burning of oilfield flared hydrocarbon gases in a limited oxygen environment within modular on-site or fixed base units. Alternately the CO and, if desired the mixture of gases, can be produced and transported to the oilfield location by trucks.

Figure 8:
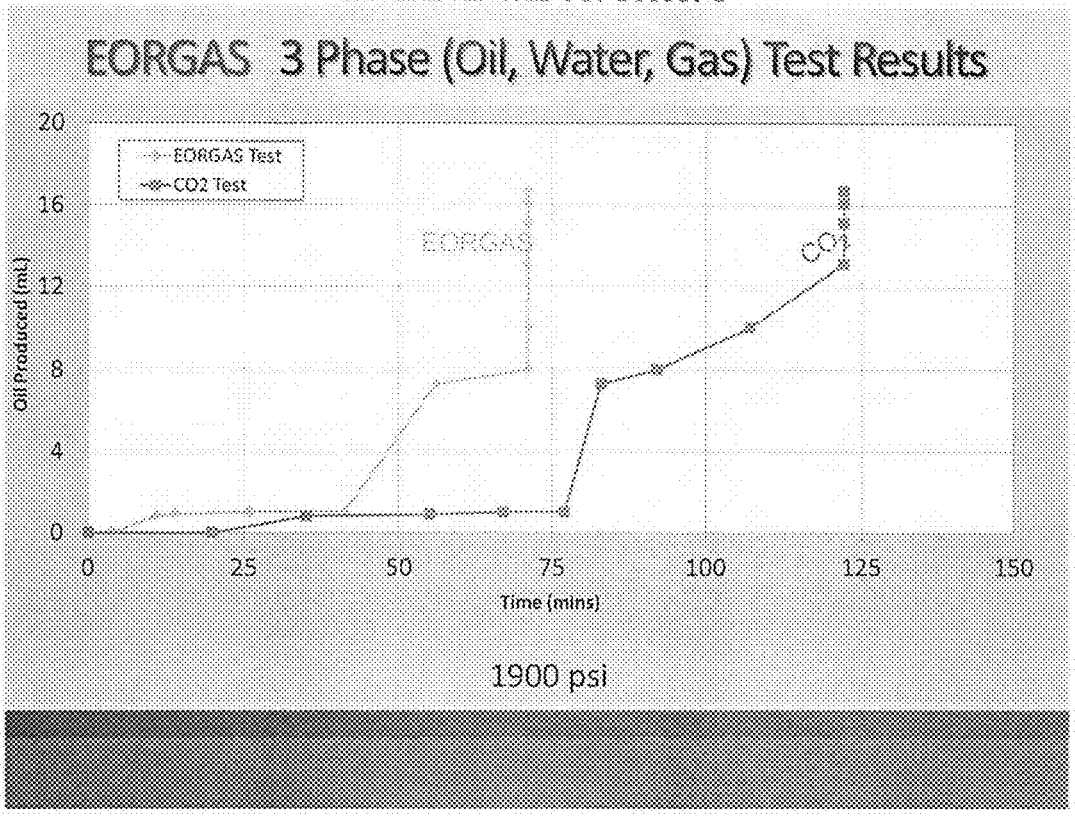
FIG. 8 is a graph providing evidence of increased oil recovery of carbon dioxide after water flooding compared to a mixture of carbon dioxide and carbon monoxide.

CO has not been previously known to provide positive effects, either by itself or mixed with CO2 and other gases, with respect to oil and gas recovery operations. Although flue gas containing a mixture of 70-80% $N_2$, 10-20% $CO_2$ and less than 3%, and more typically less than 0.3%, of CO has been historically injected to increase oil recovery by repressurizing the reservoir, the inclusion of the CO component was unintentional and due primarily as an accidental by-product of producing gas containing what were thought to be the beneficial gases and primarily $CO_2$. Consequently the beneficial effects of using CO in concentrations of greater than 3% has not been recognized. As seen in FIG. 2 oil recovery operations using $CO_2$ mixed with lower than 3% CO does not benefit or aid oil recovery. Alternately when CO concentrations reach 30% CO in a mixture of $CO_2$ and CO, a total of 81.5% of the oil was recovered under controlled testing conditions as seen in FIG. 3. And as seen in FIGS. 8 and 9 the use of CO by itself with no other gases was beneficial in recovering oil at a faster rate than pure $CO_2$. Thus addition of the CO to the $CO_2$ led to a faster solublization and dissolution of this combined gas into the oil as compared to either single gas. Thus it has been determined that increasing the CO concentration to levels greater than 3%, preferably to levels greater than 10% and more preferably to at least 20% will provide greater oil recovery than was heretofore known in the oil recovery arts. As stated above and indicated in the Figures, levels of CO greater than 20% such as 30% and 40% offer additional recovery benefits.

A further application method of using CO would be the injection of the CO in concentrations and with or without other associated gases, as described above, into reservoirs that have iron-containing minerals. In iron containing reservoirs, acidizing, fracking and water injection can result in the formation of highly hydrated iron hydroxides and oxides that then form gels. Such gels will block the channel ways for the transmission of gas and oil and water thru the reservoir and pore throats, thus severely diminishing or even stopping any oil, gas and water recovery. The reducing nature of the CO may therefore be applied to treat such reservoirs and remove the hydrated iron species, or iron gels, due to reduction of the iron to a less or non-hydroscopic form of iron. The less hydroscopic, reduced form of iron will be of a much smaller diameter and result in the re-opening of the pore throats thereby allowing reservoir fluid movement back to the producing well.

Yet another method and application comprises aiding oil and gas recovery from unconventional reservoirs such as shale oil and gas reservoirs, or other reservoirs having extremely low inherent permeability in the ranges of micro to nano-darcy permeability. These reservoirs typically contain various concentrations of iron-bearing clay minerals. The reducing nature of the CO or a mixture of gases containing CO would therefore increase the matrix permeability. Such an increase has been demonstrated by linear core flooding experiments and also by packed column testing.

As an example of the beneficial effect of adding CO to a reservoir to increase permeability and thus increase the rate of oil recovery, FIG. 3 shows the beneficial effects of repairing reservoir rock damage due to the presence of iron bearing minerals. The permeability of a packed column containing sand and 5% iron-bearing bentonite was flooded with 50,000 TDS water and the permeability was observed to be only 4.8 milli-darcys (md). However after injection of 100% CO, and allowing the CO to react with the iron hydroxides in the bentonite, the permeability was increased by 189%. Field application of CO injected in reservoirs damaged by iron-bearing clays, minerals, and the presence of hydrated iron hydroxides and oxides can thus be repaired and increased oil production may be achieved. Also as shown in FIG. 4, a linear core flood on a known oil reservoir rock with CO increased the permeability to gas by 275% and to liquids by 147%. The similarity of this and the previous packed column testing strongly supports the capability of the CO to increase reservoir permeability and thus increase the rate and total volume of oil production.

Still yet another application of CO to increase oil recovery would be the addition of the CO, or addition of a $CO/CO_2$ mixed gas, or a combination of $CO_2$, CO and $N_2$ mixed gas into a frac fluid such as water or carbon dioxide. Benefits of such addition of the CO or mixed gas containing CO would be the minimizing of water imbibing onto the frac face, formation of increased reservoir matrix permeability adjacent to the frac face, lowering the interfacial tension between the reservoir's oil and frac face water (see FIG. 5), stabilizing the reservoir's clays, minimizing the deleterious effects of any iron oxides and hydroxides and achieving a faster oil recovery plus a higher volume of total oil recovered.

Yet another application of the CO or CO-containing mixed gas is for secondary (water flooding) recovery operations to achieve increased oil recovery. CO, or CO-containing mixed gas, introduction into the water flood may result in the lowering of the interfacial tension between the water and oil (see FIG. 5), changing of the wettability of the reservoir rock, shrink water sensitive clays and associated iron hydroxides and oxides, protect the tubulars against corrosion and achieves faster oil recovery at water flood pressures after the water flood has essentially reached its economic limits. Yet another method would be the injection of the CO, with or without other associated gases, into existing or planned tertiary (EOR) oil recovery projects utilizing chemicals, such as the APS-(alkaline, polymer, surfactant) chemical floods, and also into steam floods and carbon dioxide floods. The benefit to an APS chemical flood for enhanced oil recovery is to minimize the adsorption of the chemicals on minerals having iron compounds on their surfaces. Such minerals could be, but are not limited to, iron bearing minerals and compounds, pyroxenes, amphiboles, sulfides and glauconites. Addition of CO, or CO in a mixture of gases, to a steam flood is also beneficial. Such steam floods target very viscous, high molecular weight crude oils where the oil gravity ranges from 9-14° API, reservoir temperatures are 40-90° F., viscosities are 1000 to greater than 10,000 cp, and reservoir pressures vary from 10-2000 psi. These heavy oil deposits typically are associated with iron-bearing clayey sandstones, with the clay being montmorillonite, illite, smectite, chlorite and glauconite, all of which have significant iron hydroxides content. As the steam encounters these swelling clays the reservoir's permeability will be greatly reduced. However the presence of CO may significantly alleviate this troublesome loss of permeability and its effects of loss of production of oil. Thus the CO may be very beneficial for aiding this type of oil deposits. As a further description of steam flooding, high quality steam is injected into the reservoir. Such steam injection achieves increased oil recovery due to the physical processes of heating the crude oil to lower the viscosity and simultaneously increasing the reservoir pressure to facilitate movement of the less viscous oil thru the reservoir. However with the introduction of CO or a CO mixed gas into the steam, it has been found that the chemical benefits of the CO, such as its solubility in the crude oil, solubility in asphaltenes, and the lowering of the Inter Facial Tension between the crude oil and the water phase, coupled with the small diameter of the CO will result in a combined physical and chemical recovery of the crude oil. Such a combined process may therefore achieve both a faster rate of oil production coupled with a greater amount of total oil recovered. Similarly the CO can be mixed with $CO_2$ to aid heavy oil recovery from reservoirs that are not steamed. Such a cold heavy oil recovery process, conventionally known as "CHOPS" by the oil industry, has been field tested, but the economics are poor. However by the introduction of the gas mixture of CO and $CO_2$, lower costs of heavy oil recovery may be achieved. One of the processes hindering cold heavy oil recovery is the presence of asphaltenes. These multi-ring aromatic hydrocarbons can result in plugging of the oil reservoir thereby limiting oil recovery. This plugging of the oil reservoir is often the result of deposition, adsorption and changing the wettability of the reservoir rock, all of which inhibit oil recovery. Plugging can also occur in the well bore tubular with subsequent buildup of both paraffinic and the multi-ring aromatic asphaltenes. However due to the solubility of CO in asphaltene, this plugging may be minimized and subsequently the cost of oil production decreased.

Thus injection of CO, either as a single gas component or as a mixture of CO and $CO_2$, is beneficial to the faster and greater volume of oil and gas recovery in primary, secondary, and tertiary (EOR) oilfield operations.

More specifically with respect to the method disclosed herein, CO, when injected into the reservoir, assists in the recovery of oil and gas during primary secondary, and tertiary hydrocarbon recovery operations. CO is readily available from, for example, either fixed or mobile sources utilizing pyrolysis or alternately by limiting oxygen during the burning of natural gas or flared oilfield produced gases, to produce a mixture of CO, minor $CO_2$, water vapor, and hydrogen ($H_2$). Typically this mixture of CO and $H_2$ may also contain minor amounts of $N_2$, and $CH_4$. The ratio of CO to $CO_2$ can be varied by varying the amount of pure oxygen supplied to the gas burner. Thus, if different reservoirs require different amounts of CO, or variances of the CO/$CO_2$ ratio mixture, the injected gases can be readily supplied from a single burner using various organic sources of feedstock. Other industrial processes also have the capability of producing large quantities of carbon monoxide and CO may be transported in pressurized vessels to any destination. Thus sourcing the gas is neither a technical nor economic problem. The CO produced can be transported to the oilfield in tankers or alternately produced on site at the oil field by the above, or other, processes.

The CO may be injected down hole into any reservoir, at any stage (primary, secondary, and/or tertiary) of the entire oil recovery process. Such primary stages as fracking, well bore conditioning, acidizing and intermittent well bore clean during primary, secondary, and tertiary operations is applicable. As an example of primary oil recovery applications, during fracking of the reservoir, the CO could be co-injected into the fluids of the fracking materials, or, alternately, after blow down of the frac fluids and then allow the CO to migrate outward away from the frac face and into the reservoir to achieve increased permeability of the reservoir rock to speed up oil recovery.

An example of secondary, or waterflooding, phase of oil recovery operations is a reservoir that has swelling clays, iron hydroxides, glauconite, chlorite, smectite and illite minerals. Under this application the iron stabilization will generally occur due to the reducing effects of the CO on the hydrated iron hydroxides. After treatment with CO, the permeability will be increased and water flooding (secondary) operations will produce additional oil. The demonstrated effectiveness of the mixture of CO and $CO_2$ at low pressures to recover additional oil has been shown.

An example of tertiary phase of oil production operations benefiting from the presence of CO would include injection of the CO during chemical flooding (APS) and steam flooding of heavy oil reservoirs due to solubility of the CO in the oil. In tertiary phases, the methods envisioned would be using the capability of CO to lower the Interfacial Tension, stabilize iron and utilize its small diameter. CO or CO with a mixed gas has the capability to increase reservoir matrix permeability when iron-bearing minerals or chemicals or elements are present and also may be injected into existing CO2 oil recovery projects.

In addition CO reduces hydrated iron hydroxide compounds to form non or poorly hydrated iron oxides and elemental iron. FIG. 1 demonstrates thermodynamic factors supporting such a reducing capability. This reducing capability is applicable to all phases of oil recovery operations. For example, the treatment of certain carbonate reservoirs containing trace iron is problematic due to the formation of the oxidized iron compounds during the addition of an acid treatment. The hydrated oxidized iron species forms gel-like substances that significantly impede the movement of the oil to the well bore and the CO concurrently inhibits such formation of these gel-like hydrated iron compounds. Further CO may be used with glauconite-containing reservoirs that have iron compounds present and are susceptible to formation damage, but where carbon monoxide can repair such damage.

Figure 10:
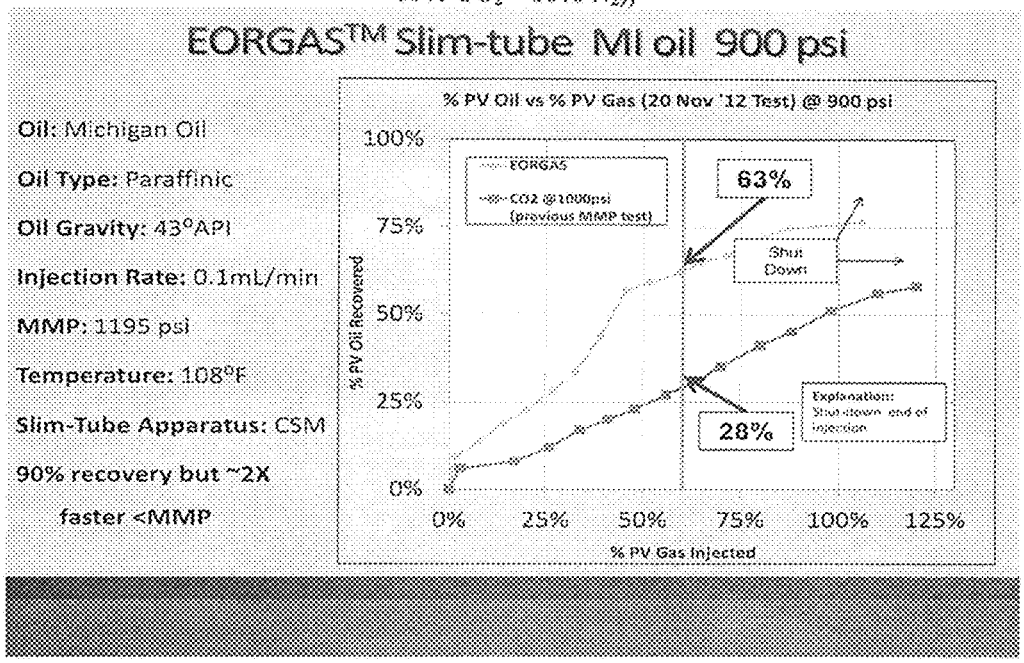
FIG. 10 is a graph demonstrating a faster rate of oil recovery of a mixture of carbon monoxide, carbon dioxide and nitrogen as opposed to carbon dioxide alone.
Figure 11:
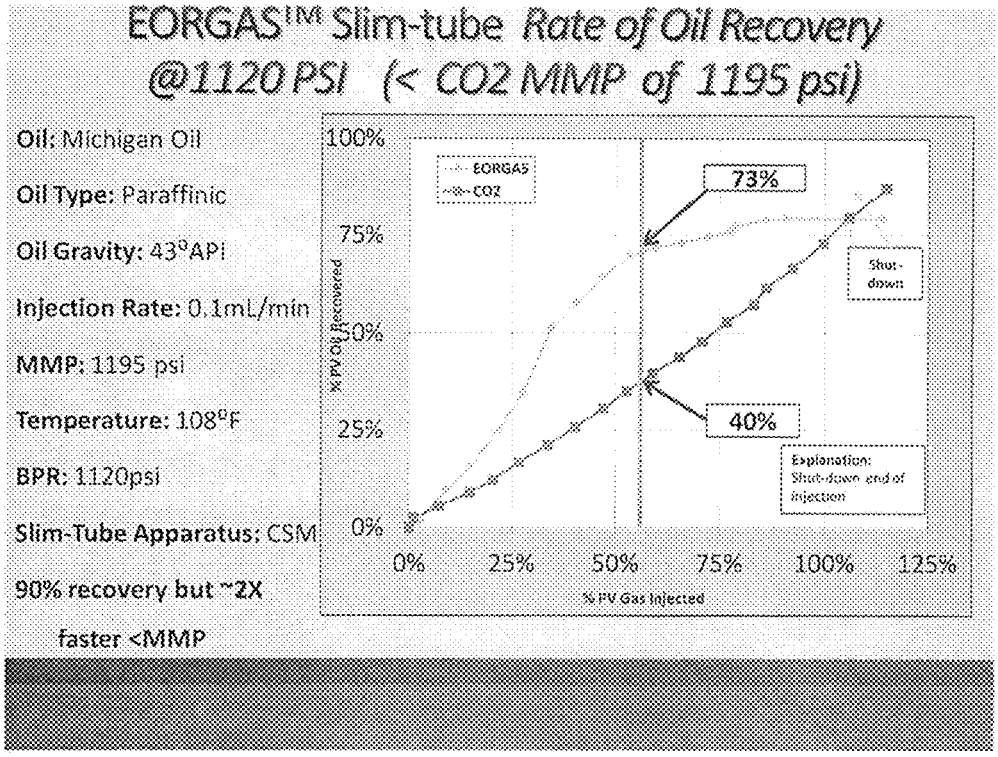
FIG. 11 is a graph indicating a faster rate of oil recovery of a mixture of gases compared to carbon dioxide alone.
Figure 12:
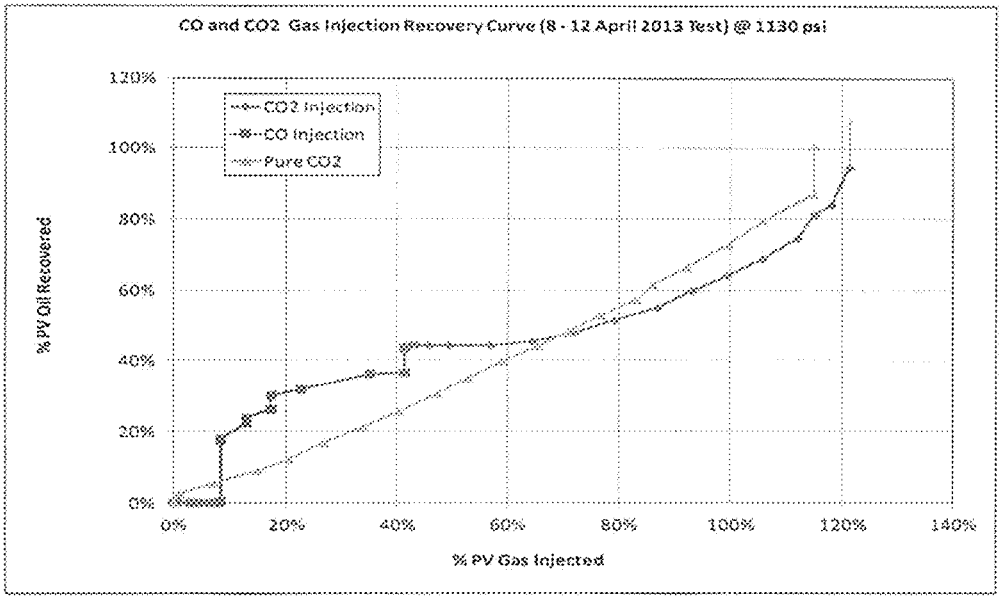
FIG. 12 is a graph indicating a faster initial rate of oil recovery using carbon monoxide compared to carbon dioxide alone.

Another application is the co-injection of the CO into existing $CO_2$, chemical or steam tertiary recovery operations to speed up the rate of oil recovery and improve the project economics. FIG. 10 and FIG. 2 both support the favorable recovery effects of the presence of CO and CO as a mixed gas for achieving faster oil recovery and for low pressure, non-miscible oil recovery of oils especially, but not limited to, oils having napthenic and asphaltene components.

Yet another application includes the increasing of reservoir permeability when certain clays such as smectitie and illite are present particularly in shale oil reservoirs. FIG. 4 depicts linear core flood results of CO into a reservoir core rock containing smectite and illite supports this observation.

The lowering of the interfacial tension between the oil and water will aid in the recovery of additional oil during fracking operations as well as post fracking operations. FIG. 5 demonstrates the lowering of the interfacial tension of the crude oil in water at atmospheric conditions. However at reservoir conditions the concentrations of the CO dissolved in the oil phase will be significantly higher as seen in FIG. 5 and thus the interfacial tension lowering will be greatly increased.

Concentrations of CO injected can range from >3-99.99+ %, and can be injected with any number of other gases such as $CO_2$, $N_2$, air, and steam, but not limited to these gases. More particularly the CO concentrations will necessarily vary depending on reservoir clay content, iron oxide/hydoxide content, and the individual oil's interaction with the CO relative to lowering the Interfacial Tension and the solubility of CO in hydrocarbons. In general the CO concentration being introduced into another gas or liquid system will vary from 3-40% by volume. Alternately the CO concentration, if injected with the purpose of remediating formation damage, or conditioning an injector or producer well, and when no significant concentration of other injected gases are present, will vary from 40-99.99%.

Examples of Beneficial Applications of CO, or CO in a Mixed Gas, to Increase Hydrocarbon Production Depending on the phase (primary, secondary or tertiary) of oil/gas recovery operations, the chemical and mineralogical nature of the reservoir rocks, and the intended purpose to be achieved, the concentrations of the CO and the method of presentation to the reservoir is variable. For example, for certain intended purposes essentially pure CO may be the desired form of presentation however for other applications CO in a mixture of $CO_2$ or, alternately, in a mixture of $CO_2$ and $N_2$, may be more advantageous to achieve the desired purposes.

Discussions of these variable reservoir conditions, phase of hydrocarbon recovery operations and reservoir mineralogy and geochemistry are thus discussed below.

1. Well Bore Remediation: Formation damage due to introduction of fresh water into a water sensitive formation containing smectite, illite, montmorillonite, bentonite, chlorite, ferric hydroxides and oxides, or glauconite. In addition formation of hydrated iron hydroxides, during acidization of carbonate reservoirs, can also result in formation damage and plugging of the pore throats (loss of permeability).
   - Chemically CO reacts with the ferric hydroxide, which is hydrated, to reduce it to ferrous oxide and elemental iron, depending on specific reservoir chemistry, both of which are much smaller diameter molecules and less water sensitive. Water of hydration is thus liberated and the pore throats are opened. As seen in FIG. 1 the thermodynamic free energy data shows this reduction of iron occurs. FIG. 4 shows linear corefloods have an increase in permeability by 275% after treatment with 100% CO. Due to the unique chemical interaction of CO and $CO_2$ as shown in FIG. 6, the rate of solubilization of a mixture of CO and $CO_2$ far exceeds the rate of solubilization of either pure CO or pure $CO_2$. Thus application for well bore remediation using a mixture of between >20%, but more preferably >30%, CO and 100% CO with approximately up to 70% $CO_2$.
2. Primary Oil Recovery Operations: Fracking. Introduction of pure CO or a mixture of CO and $CO_2$ may be beneficial due to following mechanisms:
   - Flushing oil from porosity and pore throats around well bore to effectively allow an extended, larger radius, more permeable well bore. For example a 7" well bore results in decreased flow as oil approaches well bore due to small radius, however effectively increasing the radius to 2-4' allows more oil to migrate to the well bore quicker;
   - If reservoir has water sensitive clays, reaction with the CO will increase permeability;
   - Introduction of CO, or as a CO and $CO_2$ mixed gas into the frac fluids will offer the following benefits:
     - lower IFT at the frac face thus allowing ease of oil to migrate thru the water wet frac face;
     - minimizing inhibition of water at the frac face;
     - infiltration of CO into the matrix reservoir rock forming a dentritic pattern in the shale that will act to feed the frac face with oil at a greater rate;
     - a mixture of CO and $CO_2$ will increase oil recovery as seen in FIG. 10;
     - a mixture of CO and $CO_2$, or CO alone may result in a change in the wettability of the reservoir thus achieving greater oil recovery depending on reservoir mineralogy and geochemistry.
   - Testing has shown the beneficial range of concentration of the CO is generally 30-100% as seen in FIGS. 2 and 3 and FIGS. 8-10, depending on the mineralogy of the reservoir rock, the intended purposes of the application, and local reservoir conditions.
3. Secondary (Waterflood operations): Typically water flooding operations occur after primary oil recovery is deemed uneconomic to recover an additional 10-25% of the residual oil in the reservoir. However due to fact that water moves thru the reservoir rock easier than the oil, the water flood also reaches its economic limit where the ratio of water produced to oil produced is very large and thus the water flooding operation becomes non-economic. However introduction of a mixture of CO and $CO_2$ would be beneficial to achieve a greater percentage of oil per produced barrel of water produced. Reasons for this beneficial effect are as follows:
   - The mixture of CO and $CO_2$ has been shown experimentally to achieve more oil at low pressures even after waterflooding has occurred and reached economic limits (see FIGS. 8-11);
   - CO lowers the Interfacial Tension (IFT) of the oil in the water. This allows the oil droplet to turn into a worm-like configuration and thus migrate thru smaller pore throats and the oil "worm" is more readily dragged along with the water to the well bore;
   - CO increases reservoir permeability if hydrated ferric hydroxides are present
   - The mixture of CO and $CO_2$ requires less volume of injected gas than injection of pure $CO_2$;
   - May change the wettability of the reservoir depending on reservoir mineralogy and geochemistry.
   - Testing has thus shown the effective range of concentration for the CO is 20-60% and the range of $CO_2$ is 40-80%.
4. Tertiary Oil Recovery: Injection of a combination of CO and $CO_2$, or a mixture of CO, $CO_2$, $N_2$, $H_2Ov$ and other trace gases such as $CH_4$, into the reservoir (see all prior Figures and discussions above) has shown to achieve up to three times faster oil recovery as compared to pure $CO_2$. This faster oil recovery is achieved at lower pressures and at significantly less volumes of gas injected as compared to pure $CO_2$. Reasons for these beneficial effects are as follows:

The mixture of CO and $CO_2$ has been shown experimentally to achieve more oil at low pressures even after water flooding has occurred and reached economic limits (see FIGS. 8 and 9);

CO lowers the Interfacial Tension (IFT) of the oil in the water;

CO increases reservoir permeability if hydrated ferric hydroxides are present;

The small diameter of CO as compared to $CO_2$ allows faster migration of the CO through the reservoir and associated oil and thus faster oil production; further the smaller diameter of the CO, as compared to $CO_2$, allows infiltration of the CO into zones of low permeability within the reservoir, i.e. bypassed zones, thereby achieving greater oil recovery from these zones;

Solubility of the CO in both paraffinic and aromatic hydrocarbons, at low pressures, results in faster oil recovery at pressures typically well below pressures required by $CO_2$ recovery of the same oil;

CO is fifteen times more soluble in hydrocarbons than in water thus the CO of the $CO_2$ mixture migrates to the oil-rich bypassed zones in the reservoir and facilitates hydrocarbon recovery;

CO is less soluble in water than $CO_2$ and thus prefers to enter the hydrocarbon phase and thus facilitate oil recovery;

The mixture of CO and $CO_2$, even with up to 40% $N_2$ present results in a faster rate of solubilization into the crude oil hydrocarbons than either of the pure CO or pure $CO_2$ or pure $N_2$ (see FIG. 7).

Testing has shown that the range of concentrations for Tertiary oil recovery for CO is between 20% and 60% and for $CO_2$ between 40% and 80%. This wide range is due to the reservoir mineralogy and geochemistry, particularly if iron bearing minerals or compounds are present that would react with the CO thus requiring a higher ratio of CO as compared to a reservoir that has no reactive iron-bearing minerals or compounds present.

Discussion of Steamfloods and Shale Oil Applications of CO and a Gas Mixture of CO and $CO_2$ STEAMFLOODS: Tertiary steamflood recovery operations suffer from high operating costs due to heavy, viscous nature of the oil that makes it worth less upon sale. In addition certain heavy oil reservoirs that require steam flooding to recover the oil may have swelling clays such as bentonite, illite, montmorillonite and smectite or other iron-bearing minerals such as chlorite, glauconite and ferric oxides and hydroxides that swell in the presence of water and steam. Such swelling minerals thus prohibit the infiltration of the steam into portions of the reservoir. As previously discussed the presence of the CO, either as a single gas or as a gas mixture with $CO_2$ or as a gas mixture with $CO_2$ and other gases such as $N_2$, mitigates this adverse effect of clay and mineral swelling by reacting with the ferric hydroxides and oxides to produce a reduction in valence states of the iron to elemental iron or to ferrous oxides, which are not generally hydroscopic and thus are much smaller in diameter. This reduction in diameter thus results in an increase in reservoir permeability thereby allowing the injection of the steam into these damaged portions of the reservoir. In addition steam flooding only achieves the physical effect of viscosity reduction due to temperature rise and a pressurization of the reservoir. CO or a mixture of CO and $CO_2$ would therefore be beneficial in achieving greater oil recovery due to:

Increasing permeability, thereby allowing steam to contact portions of the reservoir that were previously blocked due to steam-swelling clay reaction;

Solubility of CO in the heavy, viscous oils allowing decrease in viscosity of the oil and more migration to well bore;

CO being fairly soluble in aromatics and heavy oil deposits typically have high concentrations of aromatic (asphaltene-type) compounds;

A mixture of CO and $CO_2$ has been found to recover significant amounts of heavy oil during lab testing (see FIG. 3);

CO lowering the IFT (see discussion and benefits above and FIG. 5);

CO protecting tubular goods from corrosion, and therefore use of $CO_2$ when mixed with CO can be used with minimal adverse corrosion effects;

CO (or CO and $CO_2$) converting the physical steam flood effects to both a physical and chemical recovery process thereby achieving increased oil recovery at lower volumes of steam injected;

CO higher solubility in hydrocarbons as compared to $CO_2$ at lower pressures;

CO, or a mixture of CO and $CO_2$, may change the reservoir's wettability.

Testing has shown that the range of concentrations for Tertiary oil recovery for CO to be between 20% and 60% and for $CO_2$ to be between 40% and 80%. This wide range is due to the reservoir mineralogy, especially if iron bearing minerals or compounds are present that would react with the CO thus requiring a higher ratio of CO as compared to a reservoir that has no reactive iron-bearing minerals or compounds present.

SHALE OIL/GAS APPLICATIONS: Oil and gas production from horizontal or vertically fracked shale oil wells typically declines 30% to 50% per month thus resulting in very poor percentage of oil/gas actually recovered from the reservoir. Water flooding is typically not feasible for these reservoirs due to a combination of very high clay content resulting in very low permeability combined with the potential to swell the shale clays, thus even further decreasing the reservoir permeability. In addition the numerous natural or induced fractures of the shale would promote the bypassing of any injected fluids thru the fractures and not into the matrix of the reservoir where the residual oil is present. CO and or CO and $CO_2$ mixture would be beneficial for additional oil recovery due to:

CO lowers IFT (see above discussion);

CO increases matrix permeability to access previously trapped oil droplets;

Shale oil has high amounts of aromatic HC thus the moderate solubility of CO in the aromatics will aid recovery of oil/gas;

CO or a mixture of CO and CO2 may achieve significant oil recovery during tertiary oil recovery operations due to the demonstrated capability of achieving oil recovery at low oil pressures (see FIGS. 10 and 11) thus minimizing the loss of the introduced gas along fractures and greater infiltration of the CO or CO plus $CO_2$ gas from the fractures and into the matrix of the reservoir and where the oil resides.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method of increasing permeability of a reservoir with iron bearing minerals or compounds therein, said method including the steps of injecting a gas mixture comprising at least 3% carbon monoxide into the reservoir and reacting the carbon monoxide under reducing conditions with the iron bearing minerals or compounds by the reaction $CO+2Fe(OH)_3 \rightarrow CO_2+2FeO+3H_2O$ or $CO+2Fe(OH)_3 \rightarrow CO_2+Fe_2O_3+2H_2O+2H^+$ to increase matrix permeability.

2. The method of increasing permeability of a reservoir according to claim 1, wherein the carbon monoxide is at least 10% of the gas mixture injected into said reservoir.

3. The method of increasing permeability of a reservoir according to claim 1, wherein the carbon monoxide is at least 20% of the gas mixture injected into said reservoir.

4. The method of increasing permeability of a reservoir according to claim 1, wherein the carbon monoxide is at least 30% of the gas mixture injected into said reservoir.

5. The method of increasing permeability of a reservoir according to claim 1, wherein the carbon monoxide is greater than 40% of the gas mixture injected into said reservoir.

6. The method of increasing permeability of a reservoir according to claim 1, wherein carbon dioxide and said carbon monoxide are injected into the reservoir.

7. The method of increasing permeability of a reservoir according to claim 6, wherein a ratio of carbon monoxide to carbon dioxide is about 1:2.

8. The method of increasing permeability of a reservoir according to claim 1, wherein carbon dioxide, nitrogen and said carbon monoxide are injected into the reservoir.

9. The method of increasing permeability of a reservoir according to claim 8, wherein a ratio of carbon monoxide to carbon dioxide to nitrogen is about 3:6:1.

10. The method of increasing permeability of a reservoir according to claim 1, wherein the effective amount of carbon monoxide is essentially pure carbon monoxide.

11. The method of increasing permeability of a reservoir according to claim 1, wherein injecting a gas mixture comprises injecting pure CO.

12. The method of increasing permeability of a reservoir according to claim 1, wherein injecting a gas mixture comprises injecting a mixture of gases primarily containing CO and $CO_2$.

13. A method of increasing matrix permeability of an oil reservoir matrix having iron bearing minerals or compounds therein, said method including the steps of injecting a gas mixture comprising at least 3% carbon monoxide into a reservoir at a reservoir temperature and under reducing conditions to decrease adsorption of hydrated chemicals on the iron bearing minerals or compounds and to increase matrix permeability compared to matrix permeability without carbon monoxide present by the reaction $CO+2Fe(OH)_3 \rightarrow CO_2+2FeO+3H_2O$ or $CO+2Fe(OH)_3 \rightarrow CO_2+Fe_2O_3+2H_2O+2H^+$.

14. The method of increasing permeability of a reservoir according to claim 13, wherein the carbon monoxide is at least 10% of the gas mixture injected into said reservoir.

15. The method of increasing permeability of a reservoir according to claim 13, wherein the carbon monoxide is at least 20% of the gas mixture injected into said reservoir.

16. The method of increasing permeability of a reservoir according to claim 13, wherein the carbon monoxide is at least 30% of the gas mixture injected into said reservoir.

17. The method of increasing permeability of a reservoir according to claim 13, wherein the carbon monoxide is essentially pure carbon monoxide.

18. The method of increasing permeability of a reservoir according to claim 13, wherein said gas mixture comprises carbon monoxide and carbon dioxide.

19. The method of increasing permeability of a reservoir according to claim 18, wherein a ratio of carbon monoxide to carbon dioxide is about 1:2.

20. The method of increasing permeability of a reservoir according to claim 13, wherein said gas mixture comprises carbon monoxide, carbon dioxide and nitrogen.

21. The method of increasing permeability of a reservoir according to claim 20, wherein a ratio of carbon monoxide to carbon dioxide to nitrogen is about 3:6:1.

22. The method of increasing permeability of a reservoir according to claim 13, wherein the reservoir temperature is less than 135° F.

23. The method of increasing permeability of a reservoir according to claim 13, wherein the gas mixture primarily contains CO and $CO_2$.

* * * * *